US007959039B2

(12) United States Patent
Beckett

(10) Patent No.: US 7,959,039 B2
(45) Date of Patent: Jun. 14, 2011

(54) ACTUATOR

(75) Inventor: Clifford Edward Beckett, Berkshire (GB)

(73) Assignee: P.C. Cox Limited, Berkshire (GB)

( * ) Notice: Subject to any disclaimer, the term of this patent is extended or adjusted under 35 U.S.C. 154(b) by 433 days.

(21) Appl. No.: 12/001,280

(22) Filed: Dec. 11, 2007

(65) Prior Publication Data

US 2008/0179351 A1 Jul. 31, 2008

(30) Foreign Application Priority Data

Dec. 11, 2006 (GB) ..... 0624709.2

(51) Int. Cl.
*B67D 7/60* (2010.01)

(52) U.S. Cl. ..... 222/391; 74/141.5

(58) Field of Classification Search ..... 222/325–327, 222/386, 391, 341; 74/169, 141.5
See application file for complete search history.

(56) References Cited

U.S. PATENT DOCUMENTS

| | | | | | |
|---|---|---|---|---|---|
| 2,732,102 | A | * | 1/1956 | Ekins | 222/327 |
| 4,033,484 | A | * | 7/1977 | Ornsteen | 222/146.5 |
| 4,072,254 | A | * | 2/1978 | Cox | 222/391 |
| 4,330,070 | A | * | 5/1982 | Doubleday | 222/43 |
| 4,509,662 | A | * | 4/1985 | Weiss | 222/391 |
| 4,572,409 | A | | 2/1986 | Finnegan | |
| 4,681,524 | A | | 7/1987 | Ikeda et al. | |
| 4,706,853 | A | * | 11/1987 | Stonesifer et al. | 222/391 |
| 5,370,282 | A | | 12/1994 | Sedlmeier | |
| 5,529,225 | A | * | 6/1996 | Chang | 222/391 |
| 5,823,403 | A | * | 10/1998 | Schneider | 222/391 |
| 5,887,765 | A | * | 3/1999 | Broesamle | 222/391 |
| 6,155,463 | A | * | 12/2000 | Dentler | 222/165 |
| 6,176,398 | B1 | | 1/2001 | Chang | |
| 6,264,071 | B1 | * | 7/2001 | Dentler | 222/391 |
| 6,286,718 | B1 | | 9/2001 | Durrant | |
| 6,286,729 | B1 | * | 9/2001 | Lin | 222/391 |
| 6,691,899 | B2 | * | 2/2004 | Sung | 222/391 |
| 7,011,238 | B1 | | 3/2006 | Sung | |
| 2004/0206784 | A1 | * | 10/2004 | Chen | 222/391 |
| 2005/0006414 | A1 | * | 1/2005 | Tseng | 222/391 |
| 2005/0023301 | A1 | | 2/2005 | Rumrill et al. | |
| 2008/0047983 | A1 | * | 2/2008 | Beckett | 222/391 |

(Continued)

FOREIGN PATENT DOCUMENTS

| | | |
|---|---|---|
| EP | 0 448 375 A2 | 9/1991 |
| EP | 1 063 019 A2 | 12/2000 |

(Continued)

OTHER PUBLICATIONS

File History for U.S. Appl. No. 11/844,799, Filed Aug. 24, 2007.

(Continued)

*Primary Examiner* — Frederick C. Nicolas
(74) *Attorney, Agent, or Firm* — Patterson Thuente Christensen Pedersen, P.A.

(57) ABSTRACT

A rod actuator particularly for a mastic gun comprises wear compensation and pressure relief. The wear compensation is effected by a biased catch plate. The catch plate is released from the rod in the actuator by a sleeve transmitting a releasing force applied to a brake plate through to the catch plate. The pressure relief is provided also by the sleeve riding on the rod such that when the trigger is released the rod is able to retreat by a limited amount defined by the movement of the release plate between a released and engaged relationship with the rod.

9 Claims, 4 Drawing Sheets

FOREIGN PATENT DOCUMENTS

| | | |
|---|---|---|
| GB | 1 555 455 | 11/1979 |
| GB | 2 172 059 | 9/1986 |
| WO | WO99/37407 | 7/1999 |
| WO | WO 02/083325 | 10/2002 |

OTHER PUBLICATIONS

EPO Search Report and Communication as related to EPO Application No. 07254739.1, 50 Pages, Mar. 5, 2010.

* cited by examiner

ACTUATOR

RELATED APPLICATION

The present application claims priority to GB Application No. 0624709.2 filed Dec. 11, 2006, which is incorporated herein in its entirety by reference.

BACKGROUND OF THE INVENTION

This invention relates to an actuator for advancing a rod.

An actuator advancing a rod is used, for example, in a dispensing appliance for dispensing viscous materials such as mastic caulking material.

Viscous material, such as mastic caulking material, is commonly supplied in a cartridge having a discharge nozzle. The cartridge can be mounted in a dispensing appliance, often called a dispensing gun. An example of such a dispensing gun is described in British Patent GB 1555455. The gun has a plunger or push rod slidably mounted in a stock. The cartridge is mounted in a keep before the plunger which is advanced by means of a catch plate engaging the rod by means of a trigger lever to force a piston, inside one end of the cartridge, forward to urge the material from the nozzle at the other end. The trigger and catch plate are reset at the end of a dispensing stroke and the dispensing force can be reapplied. During dispensing, the plunger is held against the piston in the cartridge between trigger strokes by means of a locking plate.

By maintaining and reapplying a constant force on the trigger, it is found that it is possible to exert a high degree of control over the rate of discharge of mastic material. The gun is entirely acceptable as a dispensing tool for viscous material in many situations. However, it is found that the body of the cartridge expands radially under a dispensing force. Similarly, if any pockets of gas are trapped in the cartridge they will compress during discharge of the material and expand once the dispensing force is removed. As the plunger is maintained by the locking plate substantially in the position at which the dispensing force was removed from the trigger, the contracting cartridge and any expanding pocket of gas tend to cause continued dispensing of material when it is not required unless the locking plate is released manually to retreat the rod. It is sometimes desirable to be able halt the discharge immediately as the hand releases the trigger.

To address this European Patent Application EP-B-0448375 discloses a pressure relief device whereby the rod is automatically retreated at the end of a trigger stroke (that is when force is released from the trigger) by a small amount to prevent the mastic from continuing to be dispensed. The mechanism works well as a modification of a conventional type of dispensing gun in GB 1555455 for certain situations.

Another development in actuators for advancing a rod can be found in U.S. Pat. No. 5,370,282 in which the inevitable wear from which the catch plate suffers can be compensated for. This is a different approach to the typical actuation as the catch plate is now biased to an 'on' or engaged relationship with the rod and is released by movement of a device that transmits a force applied to the locking plate to release the catch plate so that the rod can be retreated manually at the end of a trigger stroke.

Both the pressure relief concept and the wear compensating concept have their benefits in, for example, mastic guns, but it has not proved possible to combine both benefits in one actuator as they are implemented in conflicting ways.

SUMMARY OF THE INVENTION

The present invention is defined in claim 1 of the accompanying claims. Some example features are recited in the dependent claims.

In embodiments of the invention an actuator for advancing a rod comprises a stock defining a channel for the rod, a catch plate member engageable with the rod, a trigger member for moving the catch member to engage and advance the rod in one direction, a release member engageable with the rod to prevent the rod from retreating in the other direction, and transmission means for transmitting a relieving force applied to the release member to the catch member to urge the catch member from engagement with the rod, thereby enabling the rod to be retreated wherein the transmission means are arranged to move with the rod so the release member moves to and from the engaged relationship with the rod.

In some embodiments the release member may be arranged to move with the rod to an engaged attitude with respect to the rod as the rod is retreated, thereafter preventing further retreat of the rod.

In some embodiments the release member may be arranged to move with the rod to a released attitude as the rod is initially advanced.

In some embodiments, the release plate may be arranged to be pivotable between the releasing and engaged relationships with the rod.

In some embodiments the transmission member may be a sleeve or other member arranged alongside the rod and extending between the release member and the catch member. In some embodiments the transmission means may be attached to the release member.

BRIEF DESCRIPTION OF THE DRAWINGS

The embodiments of the present invention may be more completely understood in consideration of the following detailed description of various embodiments of the invention in connection with the accompanying drawings in which.

Figure 1:
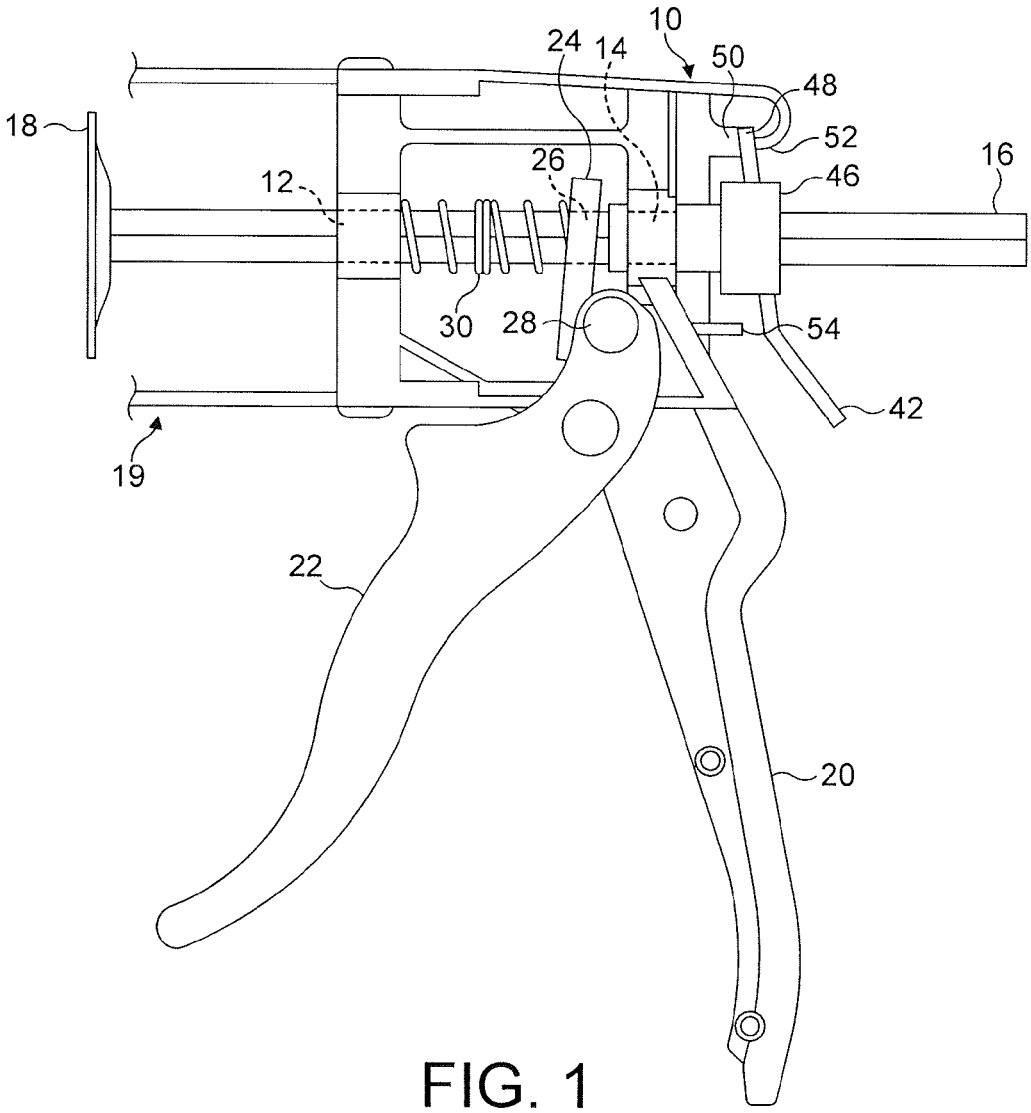
FIG. 1 is a side view of a dispensing gun having a trigger actuator for moving a drive rod.

While the present invention is amendable to various modifications and alternative forms, specifics thereof have been shown by way of example in the drawings and will be described in detail. It should be understood, however, that the intention is not to limit the present invention to the particular embodiments described. On the contrary, the intention is to cover all modifications, equivalents, and alternatives falling within the spirit and scope of the present invention.

DETAILED DESCRIPTION OF THE DRAWINGS

FIG. 1 shows a mastic gun for dispensing viscous materials, such as, for example, mastic or a caulking or sealing material. The gun comprises a stock 10 defining a pair of aligned holes 12/14 carrying a drive rod 16. The rod 16 is terminated at a front end in a plunger 18. The stock 10 also has a keep or yoke 19 (only the rear arms of which are shown) mounted on the front for holding a cartridge of material to be dispensed from a nozzle by application of a force to the plunger as the rod 16 is advanced.

A stock 10 is also formed with a downwardly depending fixed handle or butt 20 which is complemented by a trigger lever 22 pivotably mounted on the stock 10 about an axis which is transverse to the axis of the drive rod 16.

A catch plate 24 has a through hole 26 by which the catch plate 24 rides on the rod 16. A lower part of the catch plate 24 engages a transverse cross member 28 which is mounted on the trigger lever 22 above the pivot point of the trigger lever 22. A spring 30 is mounted on the rod 16 in front of the catch plate 24. The spring 30 is braced against a forward wall of the stop 10 and exerts a force on a catch plate 24 to bias the catch plate 24 into an engaged or biting attitude with respect to the rod 16. In this engaged attitude with respect to the rod 16, the catch plate 24 has an upper rear edge and a lower forward edge of that part of the catch plate 24 defining a hole 26 which bite on the rod 16 so that the force applied to the trigger lever 22 is transmitted through the catch plate 24 and translated into linear forward movement to the rod 16 through the holes 12/14 formed in the stock 10, thereby performing a dispensing action by pressing the plunger 18 onto the back of a piston in the cartridge held in the yoke (not shown).

A sleeve 40 is also mounted on the rod 16 and is free to slide in the hole 14. The sleeve 40 passes through the hole 14 for the rod 16 and acts as a movable bush for the rod 16 at the rear end of the stock 10. The sleeve 40 is held to move with a release plate 42 also mounted on the rod 16 by means of the release plate's 42 own through hole (not shown). The sleeve 40 and the release plate 42 are held together by means of a plastics jaw 46 which engages a circular flange (not shown) on one end of the sleeve 40 and receives the release plate 42 within its body. The sleeve 40 is thus carried with the movement of the release plate 42 by the jaw 46.

Figure 3:
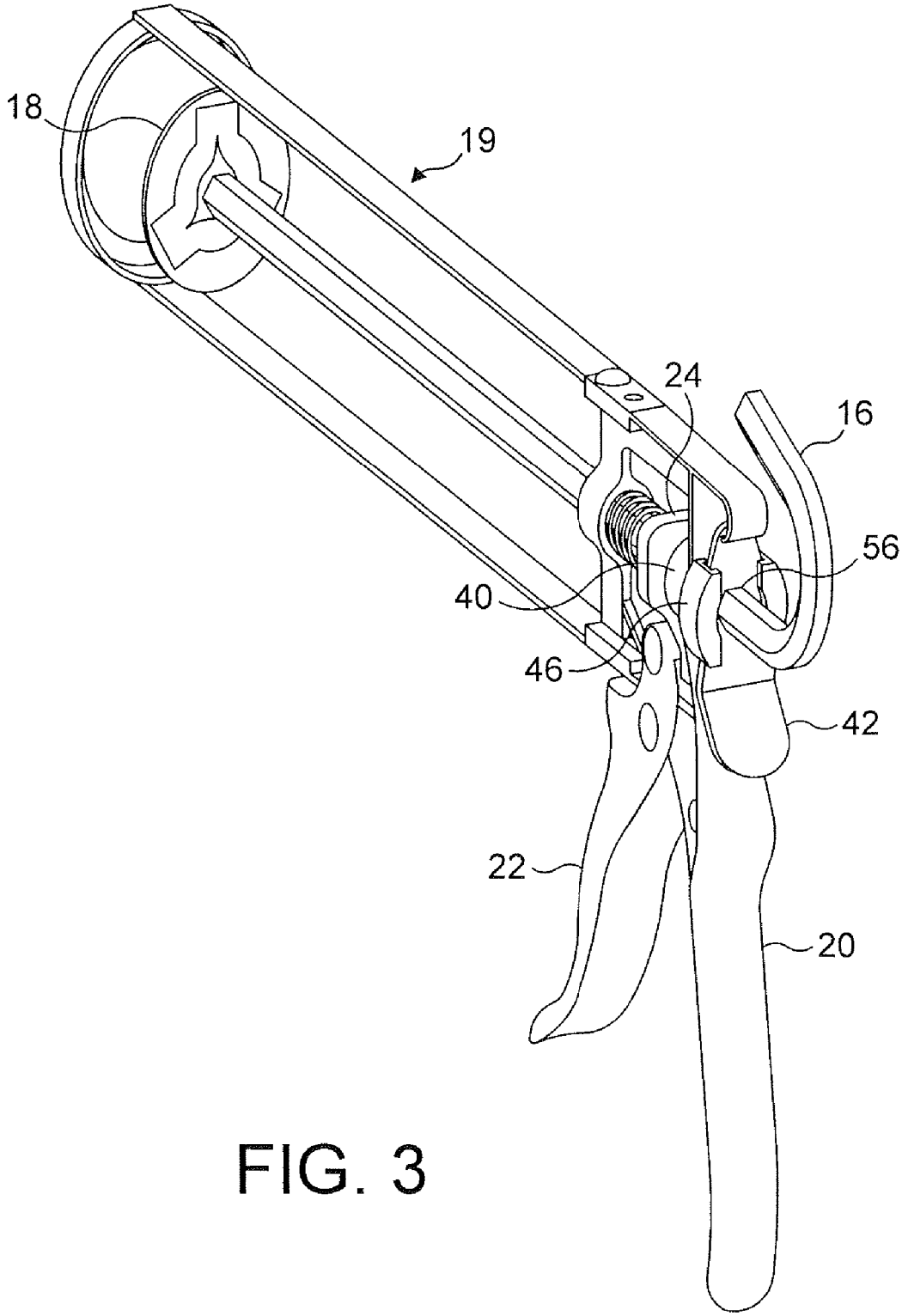
FIG. 3 is a rear perspective view of the gun of FIG. 1.

The rear of the actuator is shown in FIG. 3 which also shows the complete applicator. An upper end 48 of the release plate acts between front and rear noses 50/52.

A released or upright attitude of the release plate 42 is defined between the forward nose 50 and a lower projection 54 extending rearwardly from the back of the stock 10 beneath the rod 16. A braking or canted attitude of the release plate 42 is defined between the rear nose 52 and the biting engagement of the part of the plate 42 defining the through hole 56 for the rod 16.

FIG. 1 shows the actuator at the start of a stroke of the trigger lever 22. The trigger lever 22 is forwardly extended. The catch plate 24 is engaged with the rod 16 because the catch plate 24 is biased into that attitude by the spring 30. The release plate 42 is riding on the rod 16 together with the sleeve 40.

As the trigger lever 22 is squeezed on the rearwardly biased catch plate 24, the trigger lever 22 exerts a force on the lower part of the catch plate 24. As the catch plate 24 is already forced into engagement with the rod 16 by the force of the spring 30, the force applied to the trigger lever 22 is immediately translated into forward movement of the rod 16.

Figure 2:
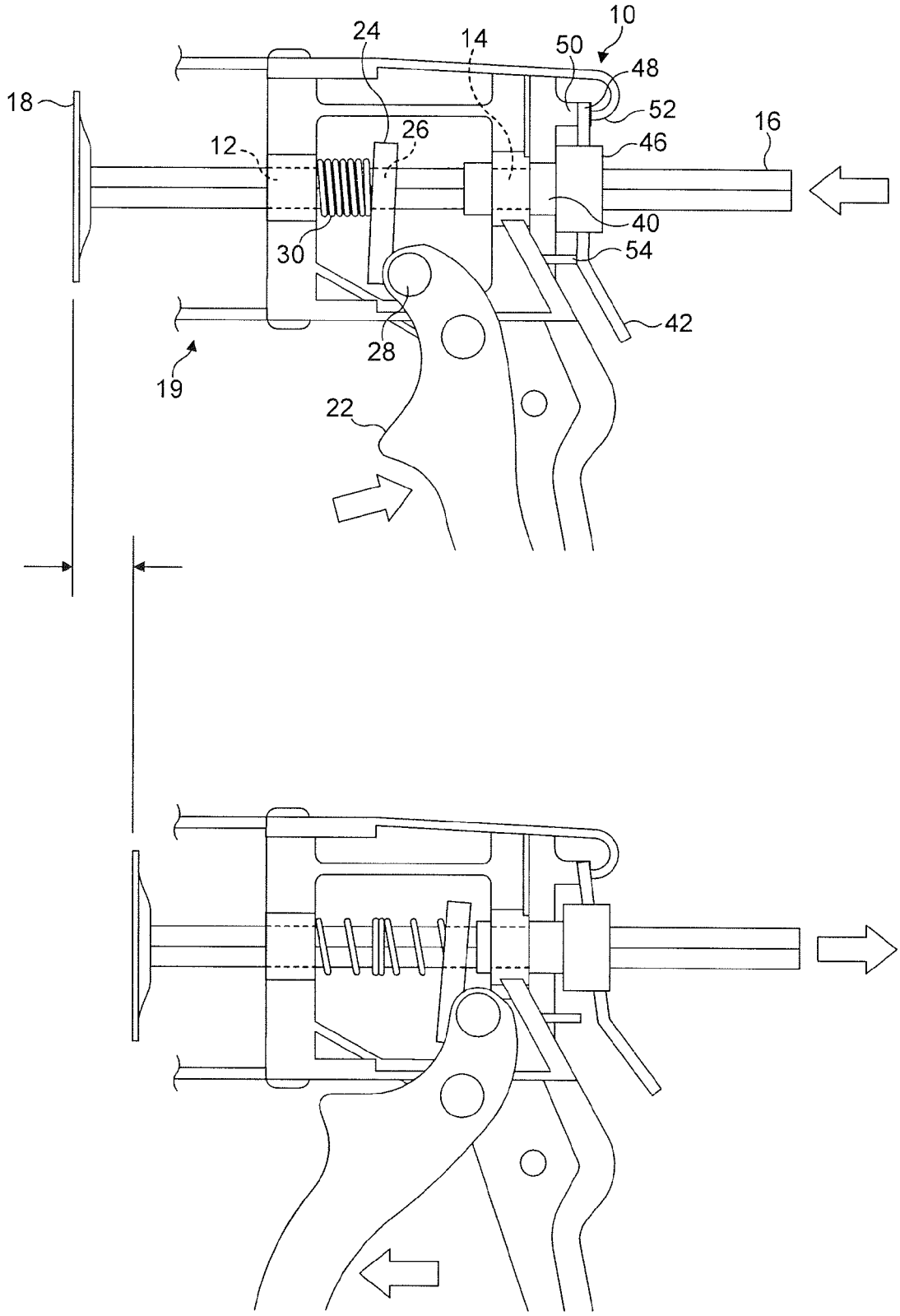
FIG. 2 illustrates the gun of FIG. 1 in a second arrangement.

The rod 16 carries the release plate 42 to the position shown in FIG. 2 and is then allowed to run past the release plate 42. However, the release plate 42 is carried to the upright or released attitude with respect to the rod 16 shown in FIG. 2 wherein the release plate 42 is engaging the forward nose 50 and the projection 54 on the stock 10. Eventually, the trigger lever 22 is moved through a full stroke (or part of a stroke) and is in the position shown in FIG. 2. Here it will be seen that the spring 30 has been compressed in front of the advanced catch plate 24.

Upon release of the trigger lever 22, the actuator assumes the arrangement shown in FIG. 1 again. The lower part of the catch plate 24 is braced against the cross member 28 by the force of the spring 30, thereby assuming an engaged relationship with the rod 16. To reach this position from that shown in FIG. 1, the catch plate 24 has slid backwards over the arrested rod 16 in the upright attitude defined by the face of the spring 30. The release plate 42 is carried backwards with the rod 16 to an engaged relationship with the rod 16 whereby the release plate 42 is engaged with the rear nose 52 and away from the projection 54. In effect, the attitude of the release plate 42 has been changed such that the forward upper edge and a rear lower edge of the part of the release plate 42 defining the hole are engaged with the rod 16 by biting on the release plate 42 so that the release plate 42 can move no further rearwardly. From releasing the force on the trigger lever 22 the rod 16 is able to retreat that small distance defined between the two (released and engaged) attitudes of the release plate 42, under the force exerted by any expanding gas in the cartridge or radial shrinkage of the cartridge itself.

Repeating the squeezing of the trigger lever 22 will advance the rod 16 for a second stroke. On applying a force to the trigger lever 22 the rod 16 is immediately engaged for movement regardless of any wear on the engaging edges of the catch plate 24.

Figure 4:
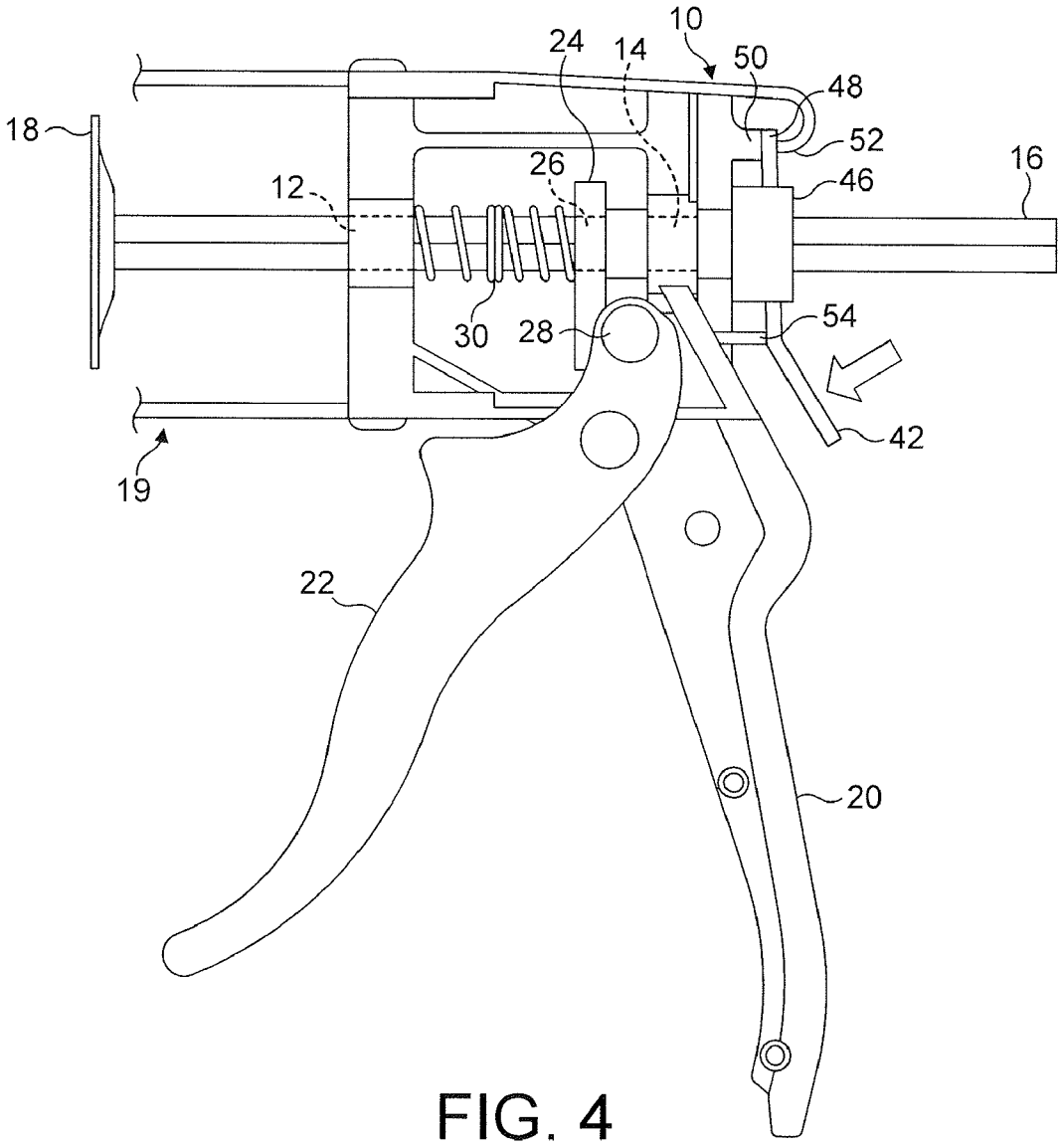
FIG. 4 illustrates the gun of FIG. 1 in a fourth arrangement.

FIG. 4 illustrates the situation in which the actuator is made ready to retreat the rod 16, for example to pull the rod 16 manually as far back as possible in order to remove an empty cartridge and/or insert a cartridge into the yoke 19. To do this a forward pressure is applied to the bottom of the release plate 42 such that the release plate 42 assumes the released or upright attitude with respect to the rod 16 and no edges of the release plate 42 defining its hole are biting on the rod 16. This movement of the release plate 42 enabling the rod 16 to slide freely is transmitted by the sleeve 40 to the catch plate 24 so that the catch plate 24 too is urged into an upright disengaged relationship slightly forward of the engaged relationship. The force applied through the sleeve moves the catch plate 24 upright and away from the cross member 28 against the force of the spring 30.

The actuator disclosed requires only a single spring 30, i.e., that to bias the catch plate 24, and uses an advantageous connection with the release plate 42 both to transmit the releasing force applied to the release plate 42 and to create a frictional engagement whereby the release plate 42 can ride between the two positions of engagement and release from the rod 16.

It will be appreciated that the parts of the actuator can be made of metal or plastics. In an example embodiment, plates 24, 42 are steel, the stock 10 and the trigger lever 22 are cast aluminium/zinc or a suitably rigid plastics such as polypropylene, glass filled nylon or ABS, and the rod 16 is made of steel. The rod 16 can be round, hexagonal or any other shape in section. While the engagement by the plates 24, 42 on the rod 16 includes the use of through holes in the plates 24, 42, it can equally well be by means of open slots as long as the plates 24, 42 define engaging parts which bite on the rod 16 when engaging the rod 16 either to drive the rod 16 forward or prevent the rod 16 from retreating. Likewise, the sleeve for transmitting the force applied to the release plate 42 and to the catch plate 24 could equally well be any other member extending between the plates 24, 42. For example, a member or members extending alongside the rod 16 could transmit the forces between the two plates 24, 42. The collar and the sleeve (or some other device) can be separate pieces or a single plastics moulding. In an example embodiment, the release plate 42 is free enough within the collar to move between its two attitudes.

In other embodiments the release plate 42 can be biased to its engaged position by a spring 30. In this form, advance of the rod 16 causes very small forward movement of the release plate 42 from the engaged position, but is the same in its effect. To release the engagement manually the release plate 42 is depressed as before against the projection 54. In this form there may not be a discernable change in the attitude of the release plate 42 with respect to the rod 16, but it still permits the rod 16 to advance and moves to create the play by which the pressure relief is realised on retreat of the rod 16.

The invention claimed is:

1. An actuator for advancing a rod comprising:

a stock defining a channel for the rod;

a catch member engageable with the rod;

a trigger member for moving the catch member to engage and advance the rod in a first direction;

a release member engageable with the rod to prevent the rod from retreating in a second direction substantially opposite the first direction; and a sleeve on the rod, extending between the release member and the catch member for transmitting a relieving force applied to the release member to the catch member to urge the catch member from engagement with the rod, thereby enabling the rod to be moveable in the second direction;

wherein the sleeve is held to move with the release member and is arranged to move with the rod such that the release member moves with the rod to and from an engaged relationship with the rod.

2. The actuator of claim 1, wherein the release member is arranged to move with the rod to an engaged attitude with respect to the rod as the rod is retreated, thereafter preventing further retreat of the rod.

3. The actuator of claim 1, wherein the release member is arranged to move with the rod as the rod is initially advanced.

4. The actuator of claim 1, wherein the release plate is arranged to be movable between a released and an engaged attitude with respect to the rod.

5. The actuator of claim 1, wherein the catch member is a catch plate biased into an attitude of engagement with respect to the rod so that actuation of the trigger causes immediate movement of the catch member and the rod.

6. The actuator of claim 5, wherein the release member is operable to release the rod and transmit its movement through the sleeve to move the catch plate to release the rod.

7. The actuator of claim 6, wherein the release member is a release plate moveable between an engaged attitude and a released attitude with respect to the rod.

8. The actuator of claim 1, wherein the actuator is operable in a mastic applicator.

9. An actuator for advancing a rod comprising:

a stock defining a channel for the rod;

a catch member engageable with the rod;

a trigger member for moving the catch member to engage and advance the rod in a first direction;

a release member engageable with the rod to prevent the rod from retreating in a second direction substantially opposite the first direction; and a sleeve on the rod, extending between the release member and the catch member for transmitting a relieving force applied to the release member to the catch member to urge the catch member from engagement with the rod, thereby enabling the rod to be moveable in the second direction;

wherein the sleeve is held to move with the release member and is arranged to move with the rod such that the release member moves with the rod to and from an engaged relationship with the rod, wherein the sleeve is held to move with the release member by means of a jaw which engages a flange on one end of the sleeve and receives the release member within its body.

* * * * *

UNITED STATES PATENT AND TRADEMARK OFFICE

CERTIFICATE OF CORRECTION

PATENT NO. : 7,959,039 B2
APPLICATION NO. : 12/001280
DATED : June 14, 2011
INVENTOR(S) : Beckett It is certified that error appears in the above-identified patent and that said Letters Patent is hereby corrected as shown below:

On the Title Pg Item 56:
Under "U.S. PATENT DOCUMENTS" insert -- 2008/0197155 A1* 08/2008 Liang 222/391 --.

Column 1, Line 41:
After "able" insert -- to --.

Signed and Sealed this
Twentieth Day of December, 2011

David J. Kappos

David J. Kappos
*Director of the United States Patent and Trademark Office*